US012186627B2

(12) United States Patent
Cei

(10) Patent No.: US 12,186,627 B2
(45) Date of Patent: Jan. 7, 2025

(54) EXERCISE MACHINE WITH POWER-CONTROLLED TRAINING MODE AND METHOD THEREOF

(71) Applicant: TECHNOGYM S.P.A., Forli'-Cesena (IT)

(72) Inventor: Daniele Cei, Forli'-Cesena (IT)

(73) Assignee: TECHNOGYM S.P.A., Forli'-Cesena (IT)

( * ) Notice: Subject to any disclaimer, the term of this patent is extended or adjusted under 35 U.S.C. 154(b) by 0 days.

(21) Appl. No.: 17/070,367

(22) Filed: Oct. 14, 2020

(65) Prior Publication Data

US 2021/0106874 A1 Apr. 15, 2021

(30) Foreign Application Priority Data

Oct. 15, 2019 (IT) ..... 102019000018878

(51) Int. Cl.
*A63B 24/00* (2006.01)
*A63B 22/06* (2006.01)

(52) U.S. Cl.
CPC ..... *A63B 24/0062* (2013.01); *A63B 22/0605* (2013.01); *A63B 24/0075* (2013.01); *A63B 24/0087* (2013.01); *A63B 2024/0068* (2013.01); *A63B 2024/0093* (2013.01)

(58) Field of Classification Search
None
See application file for complete search history.

(56) References Cited

U.S. PATENT DOCUMENTS

2008/0207401 A1 8/2008 Harding et al.
2008/0300498 A1* 12/2008 Edwards ..... A61B 5/024 482/9
2010/0179028 A1 7/2010 Watterson et al.
2013/0123071 A1* 5/2013 Rhea ..... A63B 24/00 482/8
2014/0171266 A1* 6/2014 Hawkins, III ..... A63B 21/225 482/5
2016/0256745 A1 9/2016 Brammer
2020/0276475 A1* 9/2020 Casalini ..... G16H 20/30
2021/0077887 A1* 3/2021 Moritz ..... A63B 22/0235
2021/0106875 A1* 4/2021 Hansen ..... A63B 24/0087

FOREIGN PATENT DOCUMENTS

EP 3 164 823 A1 5/2017
IT UB20159480 * 6/2017
IT UB20159480 A1 * 6/2017

OTHER PUBLICATIONS

Extended European Search Report for European Patent Application No. 20201850.3 mailed Feb. 16, 2021, 9 pages.
Italian Search Report for corresponding Italian Patent Application No. 102019000018878 mailed Aug. 4, 2020, 8 pages.

* cited by examiner

*Primary Examiner* — Shila Jalalzadeh Abyaneh
(74) *Attorney, Agent, or Firm* — Merchant & Gould P.C.

(57) ABSTRACT

An exercise machine is configured to have a power-controlled training mode. The exercise machine is configured to vary a percentage of a parameter representative of the athletic preparation of a user. The exercise machine is also configured to perform the power control by following a power target value delivered by the user during the physical activity, the target value being determined based on a percentage of the parameter representative of the athletic preparation of a user.

17 Claims, 9 Drawing Sheets

| | CL1 | CL2 | CL3 | CL4 |
|---|---|---|---|---|
| Z1 | C1 | N1 | PT1 ≤ 55 % | FC1 ≤ 60 % |
| Z2 | C2 | N2 | 56 < PT2 < 75 % | 61 < FC2 < 70 % |
| Z3 | C3 | N3 | 76 < PT3 < 90 % | 71 < FC3 < 80 % |
| Z4 | C4 | N4 | 91 < PT4 < 105 % | 81 < FC4 < 90 % |
| Z5 | C5 | N5 | 106 < PT5 < 120 % | 91 < FC5 < 100 % |
| Z6 | C6 | N6 | 121 < PT6 < 150 % | FC6: NA |
| Z7 | C7 | N7 | PT7: NA | FC7: NA |

100

| | CL1 | CL2 | CL3 | CL4 |
|---|---|---|---|---|
| Z1 | C1 | N1 | PT1 ≤ 55 % | FC1 ≤ 60 % |
| Z2 | C2 | N2 | 56 < PT2 < 75 % | 61 < FC2 < 70 % |
| Z3 | C3 | N3 | 76 < PT3 < 90 % | 71 < FC3 < 80 % |
| Z4 | C4 | N4 | 91 < PT4 < 105 % | 81 < FC4 < 90 % |
| Z5 | C5 | N5 | 106 < PT5 < 120 % | 91 < FC5 < 100 % |
| Z6 | C6 | N6 | 121 < PT6 < 150 % | FC6: NA |
| Z7 | C7 | N7 | PT7: NA | FC7: NA |

Fig. 7

EXERCISE MACHINE WITH POWER-CONTROLLED TRAINING MODE AND METHOD THEREOF

This application claims benefit of Serial No. 102019000018878, filed 15 Oct. 2019 in Italy and which application is incorporated herein by reference. To the extent appropriate, a claim of priority is made to the above disclosed application.

FIELD OF THE INVENTION

The present invention relates to the fitness sector and, in particular, to an exercise machine with power-controlled training mode and a method thereof.

Technological Background of the Invention

Nowadays, there are exercise machines including a power-controlled training mode.

For example, in the case of an exercise bike or stationary bicycle, such a training mode includes controlling the power which can be delivered by the user while pedaling to follow a target value previously set by the user.

In this regard, the user can vary such a target value manually, e.g. on a touchscreen control panel on the exercise bike, following a command, e.g. a voice command, imparted by a personal trainer.

The variation of such a target value is typically an absolute variation of the power which can be delivered by the user while pedaling (e.g. each manual action by the user on the control panel corresponds to an increase or decrease of one Watt or a multiple of one Watt).

Therefore, considering that different users may have a different athletic preparation, if the personal trainer asks the users of a training class to set a value which is actually adequate to their athletic preparation as the target value of the power which can be delivered by the user while pedaling, a user with high athletic preparation will have to operate the variation of the absolute value of power which can be delivered by the user while pedaling several times compared to a user with less athletic preparation.

Therefore, the use of such a training mode is not very user-friendly, versatile, or precise, especially in conditions in which the users are under strain and/or fatigued and have very different athletic preparations.

SUMMARY

It is the object of the present invention to devise and provide an exercise machine with power-control training mode which allows to obviate, at least partially, the drawbacks described above with reference to the prior art, in particular which is as user-friendly, efficient, versatile and precise to use as possible.

Such an object is achieved by an exercise machine configured to assume a power-controlled training mode, wherein the exercise machine is configured to:

- vary a percentage of a parameter representative of the athletic preparation of a user,
- perform the power control by following a target power value delivered by the user during the physical activity, such a target value being determined on the basis of a percentage of the parameter representative of the athletic preparation of a user.

The present invention also relates to a power-controlled training method which can be performed on an exercise machine, comprising steps of:

- varying a percentage of a parameter representative of the athletic preparation of a user;
- performing the power control by following a target power value delivered by the user during the physical activity, the target value being determined on the basis of a percentage of the parameter representative of the athletic preparation of a user.

Preferred embodiments of said exercise machine and said method are defined in the respective dependent claims.

BRIEF DESCRIPTION OF THE DRAWINGS

Further features and advantages of the exercise machine and of such a method according to the invention will become apparent from the following description of preferred embodiments, given by way of indicative, non-limiting examples, with reference to the accompanying drawings, in which:

FIG. 7 shows an example of a training or working zone table into which a user's training can be divided as a function of a percentage of a parameter representative of an athletic preparation of a user.

It is worth noting that equivalent or similar elements are indicated by the same numerical and/or alphanumerical reference in the aforesaid figures.

DETAILED DESCRIPTION

Figure 1A:
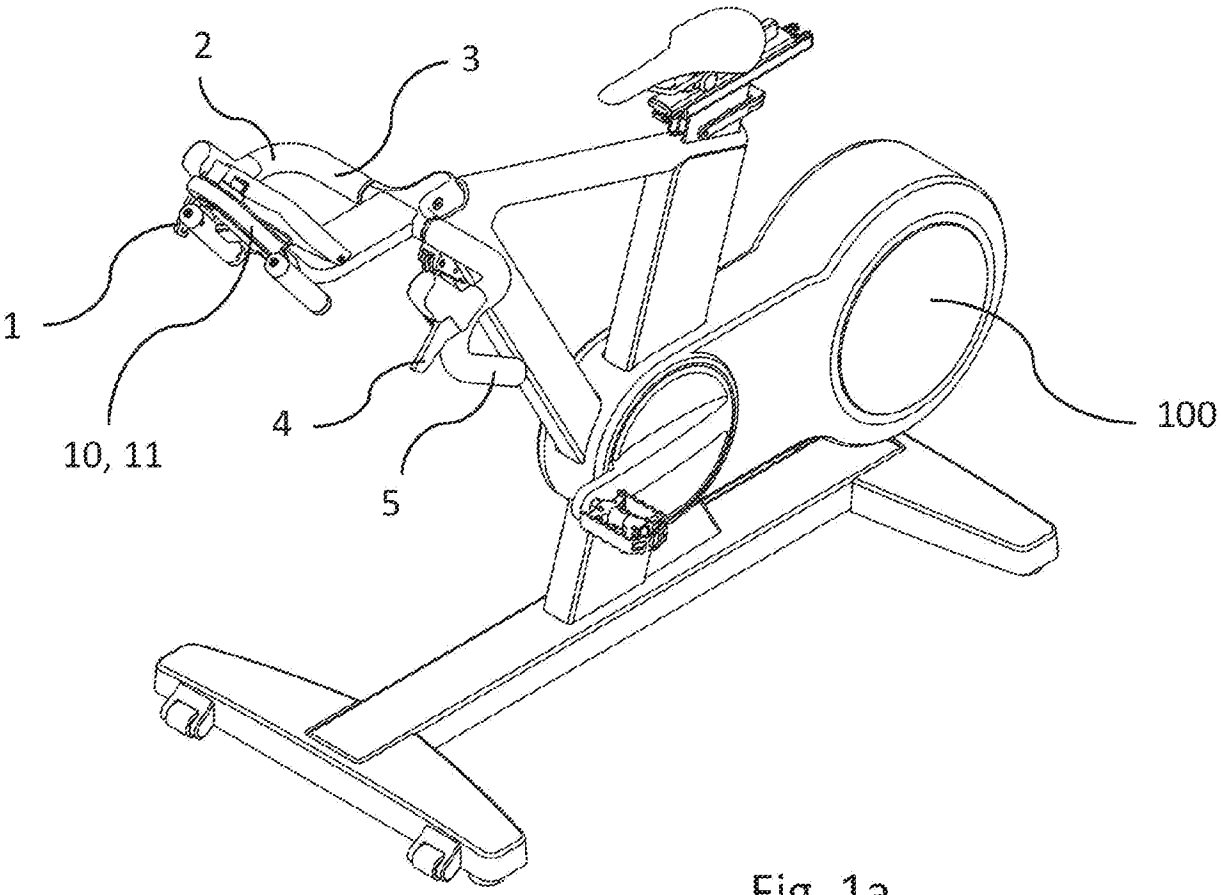
FIG. 1*a* shows an exercise machine according to an embodiment of the present invention.
Figure 1B:
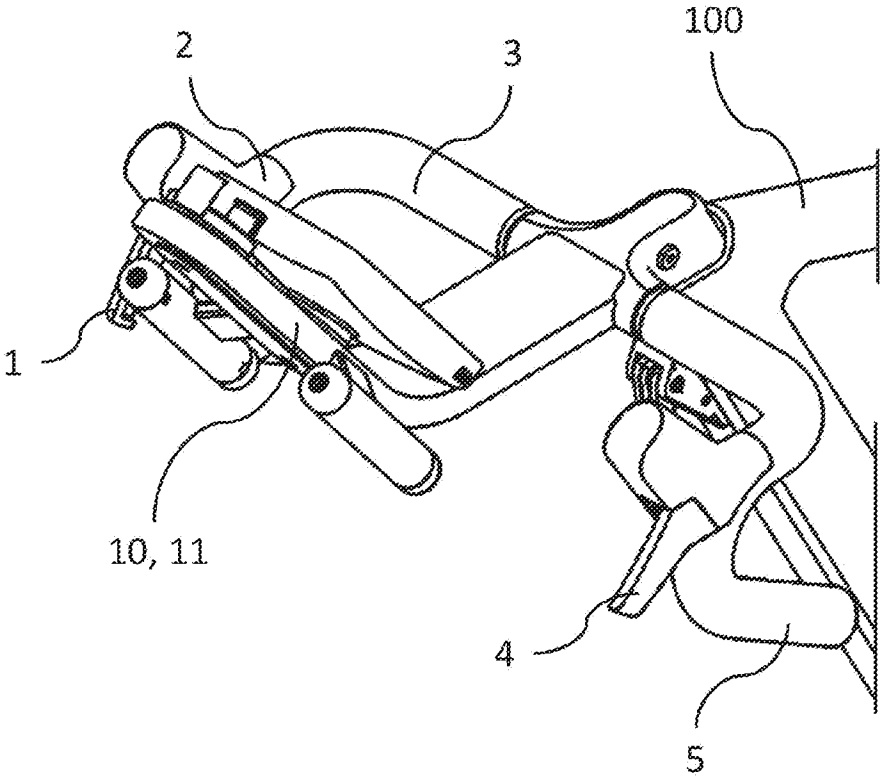
FIG. 1*b* shows an enlargement of a portion of the exercise machine in FIG. 1*a;*
Figure 2B:
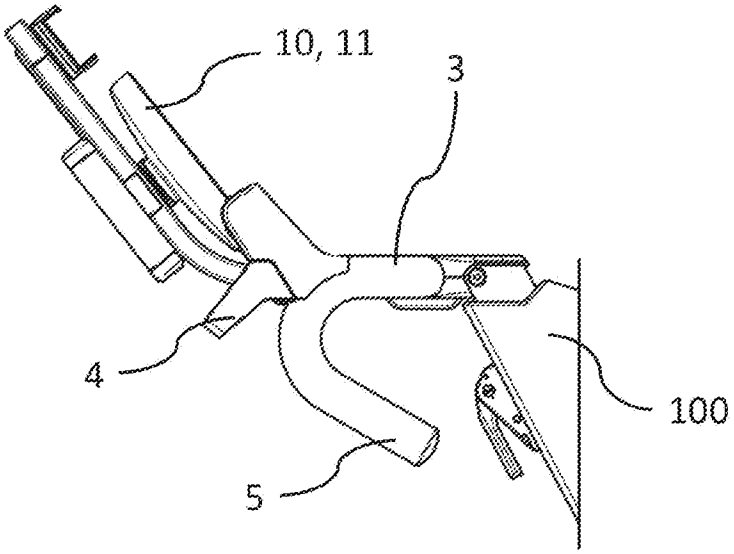
FIGS. 2*a* and 2*b* show side views of a portion of the exercise machine in FIG. 1*a,*
Figure 2A:
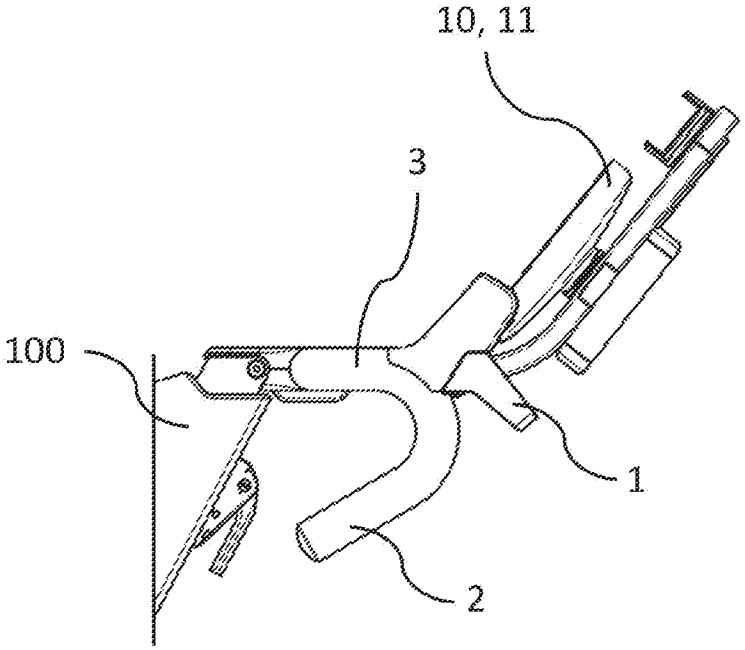

An exercise machine 100 according to the present invention will now be described with reference to the aforesaid figures.

The exercise machine 100 may be any exercise machine configured to take a power-controlled training mode.

Examples of such an exercise machine are an exercise bike or stationary bicycle, a treadmill, and so on.

The example of an exercise machine shown in the figures is an exercise bike or stationary bicycle.

"Power-controlled training mode" means a training mode in which the exercise machine is configured, once the power-controlled training mode is set, to control the power delivered by the user during physical activity so that it is kept equal to a respective set target value.

In the case of an exercise bike or stationary bicycle, the power to be controlled is the power supplied by the user while pedaling.

The set target value can be the one which is set on the exercise machine in the starting moment of the training in training mode or the one that is subsequently set by the user, as described below.

Such a control can also be defined as adjustment or following of the target value and can occur during the entire training or only during set intervals of time or portions of the training.

According to an embodiment, the exercise machine 100 is configured to vary a percentage of a parameter representative of the athletic preparation of the user.

Furthermore, the exercise machine 100 is configured to perform the power-control by following a target power value delivered by the user during the physical activity. Such a target value is determined on the basis of the percentage of the parameter representative of the athletic preparation of the user.

Such a "parameter representative of the athletic preparation of the user" can be determined as a function of the user's physiological variables (e.g. heart rate, weight, height, age) by means of an appropriate mathematical algorithm.

An example of such a parameter is the Functional Threshold Power (FTP), hereinafter also simply FTP.

The functional threshold power FTP value is the maximum power which can be expressed by a user in an hour and is established for each user by means of appropriate mathematical algorithms which require the user to perform appropriate physical tests.

In greater detail, there are appropriate mathematical algorithms for calculating the threshold power value of a user which allow to estimate the threshold power value following a physical test which subjects the user to a high effort for a set time interval (e.g. 20 minutes).

Such algorithms require the user to enter given personal data, such as age, weight, height, and the like into the control system of the exercise machine.

It is known that users training at preset threshold power value percentages can achieve given results in terms of training and improvement of their physical abilities.

In this regard, the table in FIG. 7 shows an example of indication of training or working areas or zones into which a training can be divided on the basis of the FTP training percentage.

The table comprises a first column CL1, showing the colors of the training zones, a second column CL2, showing the names of the training zones, a third column CL3, showing the power ranges relative to FTP percentages of the training zones, and a fourth column CL4, showing the heart rate ranges relative to maximum heart rate percentages of the training zones.

Each row in the table corresponds to a training zone.

A first training zone Z1 with the following features is shown on the first line:

Color C1: blue;

Name N1: active recovery;

Power PT1: ≤55% FTP;

Heart rate HR1: ≤60% of the maximum heart rate.

The first training zone has a power lower than 55% of the FTP and is mainly used for recovery sessions after intensive training or sports competitions, or during recovery phases between exercises or during the final phases of training.

A second training zone Z2 with the following features is shown on the second line:

Color C2: green;

Name N2: endurance;

Power PT2=56-75% of FTP;

Heart rate FC2=61-70% of the maximum heart rate;

A training in the second training zone Z2 (with power between 56% and 75% of FTP) is aimed at improving the general aerobic condition, therefore generally associated with a long session, which should indeed be carried out mainly in this second training zone Z2, which allows to improve the heart contraction strength and muscle capillarization.

A third training zone Z3 with the following features is shown on the third line:

Color C3=yellow;

Name N3=time;

PT3 Power=76-90% of FTP;

Heart rate FC3=71-80% of the maximum heart rate.

In the third training zone Z3, the training power is between 76% and 90% of the FTP and allows to improve the general athletic preparation level. A fourth training zone Z4 with the following features is shown on the fourth line:

Color C4=orange;

Name N4=anaerobic threshold;

PT4 Power=91-105% of FTP,

Heart rate FC4=81-90% of the maximum heart rate.

In the fourth training zone Z4, the power is between 91% and 105% of FTP, and the training in this fourth training zone Z4 is aimed at increasing the functional threshold power FTP. The type of training in this fourth training zone Z4 is reserved for users with good athletic preparation and a good performance level, e.g. to reduce the uphill climbing time.

A fifth training zone Z5 with the following features is shown on the fifth line:

Color C5=red;

Name N5=VO2max;

Power PT5=106-120% of FTP;

Heart rate FC4=91-100% of the maximum heart rate.

In the fifth training zone Z5, the power is between 106% and 120% of FTP and the training carried out in this training zone (e.g. between 3 and 8 minutes) allows to improve the maximum oxygen consumption.

A sixth training zone Z6 with the following features is shown on the sixth line:

Color C6=red;

Name N6=anaerobic capacity;

Power % PP6=121-150% FTP;

Heart rate FC6=not available (NA).

In the sixth training zone Z6, the power is between 121% and 150% of FTP and the training in this training zone (typically less than 2 minutes, with many changes of pace and peak effort) allows to improve the anaerobic abilities (lactic acid tolerance).

A seventh training zone Z7 with the following features is shown on the seventh line:

Color C7=red;

Name N7=neuromuscular power;

Power PT7=not available (NO);

Heart rate PT7=not available (NA).

The training in this training zone is very short (typically not exceeding 10 seconds), performed at maximum intensity, and allows the improvement of the neuromuscular system also stimulating the metabolic system.

Turning back to the embodiment according to the present invention, in the power-controlled training mode, it reiterates that the power delivered by the user during the physical activity is the parameter to be controlled so that it corresponds to a target value.

Such a target value is determined on the basis of a percentage of a parameter representative of the athletic preparation of the user, e.g. on the basis of a percentage of FTP.

As mentioned above, the percentage of the parameter representative of the athletic preparation of the user is variable.

According to an embodiment, in the power-controlled training mode, in which the target power value is determined on the basis of the percentage of a parameter representative of the athletic preparation of the user, a change (either increase or decrease) of the percentage of the parameter representative of the athletic preparation of the user (e.g. the percentage of FTP) which is equal for all users corresponds to a change (either increase or decrease, respectively) of the target power value delivered by the user during the physical activity, which change is different from user to user.

According to a further embodiment, either as an alternative to or in combination with the preceding one, in the power-controlled training mode, in which the target power value is determined on the basis of the percentage of a parameter representative of the athletic preparation of the user, the determination of the target power value delivered by the user during the physical activity takes place, relative to a previous target power value, by varying the target power value by an absolute discrete value which is different from user to user, while the percentage of the parameter representative of the athletic preparation of the user (e.g. the percentage of FTP) is the same for all users.

In an embodiment, according to any one of those described above, the percentage of the parameter representative of the athletic preparation of the user can be manually varied by the user.

In a further embodiment, the percentage of the parameter representative of the athletic preparation of the user can be automatically varied by the exercise machine 100 on the basis of an set trend (e.g. over time) set in the user's training program.

According to an embodiment, in combination with any one of those described above, the exercise machine 100 is configured to take a further resistance-controlled training mode.

In the resistance-controlled training mode, the exercise machine 100 is configured to:

vary a target resistance value of the exercise machine in opposition to the physical activity of the user;

perform the resistance-control by following a target resistance value of the exercise machine in opposition to the physical activity of the user.

In the case of an exercise bike or stationary bicycle, the parameter to be controlled is the resistance of the exercise bike in opposition to the user's pedaling.

In this embodiment, the exercise machine 100 is, for example, configured to switch from the further resistance-controlled training mode, set by default when the exercise machine 100 is switched on, to the power-controlled training mode, in which the target power value is determined on the basis of a percentage of a parameter representative of the athletic preparation of the user, and viceversa.

According to a further embodiment, in combination with the preceding ones, the exercise machine 100 is configured to take a further power-controlled training mode, in which the target power value is determined on the basis of an absolute value of the power delivered by the user during the physical activity (in the case of an exercise bike or stationary bicycle, during pedaling).

In the further power-controlled training mode, in which the target power value is determined on the basis of an absolute value of the power delivered by the user during the physical activity, the exercise machine 100 is configured to:

vary a target value of a power delivered by the user during physical activity;

perform the power-control by following the target power value delivered by the user during the physical activity.

In this embodiment, the exercise machine 100 is configured to switch from the further resistance-controlled training mode, set by default when the exercise machine 100 is turned on, to the power-controlled training mode, in which the target power value is an absolute value of the power delivered by the user during the physical activity, and viceversa.

Figure 4A:
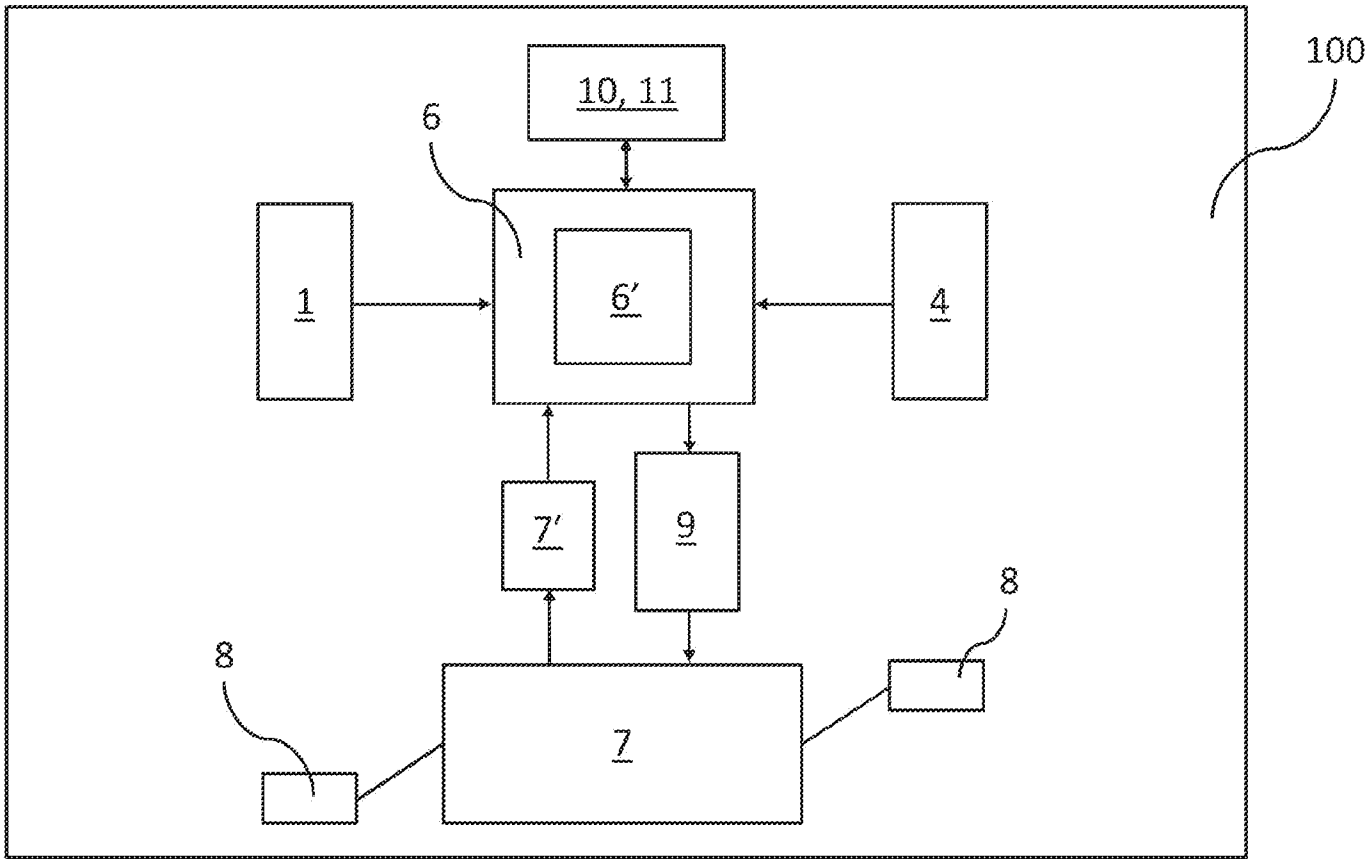
FIG. 4*a* shows, by means of a block chart, an exercise machine according to an embodiment of the present invention.
Figure 4B:
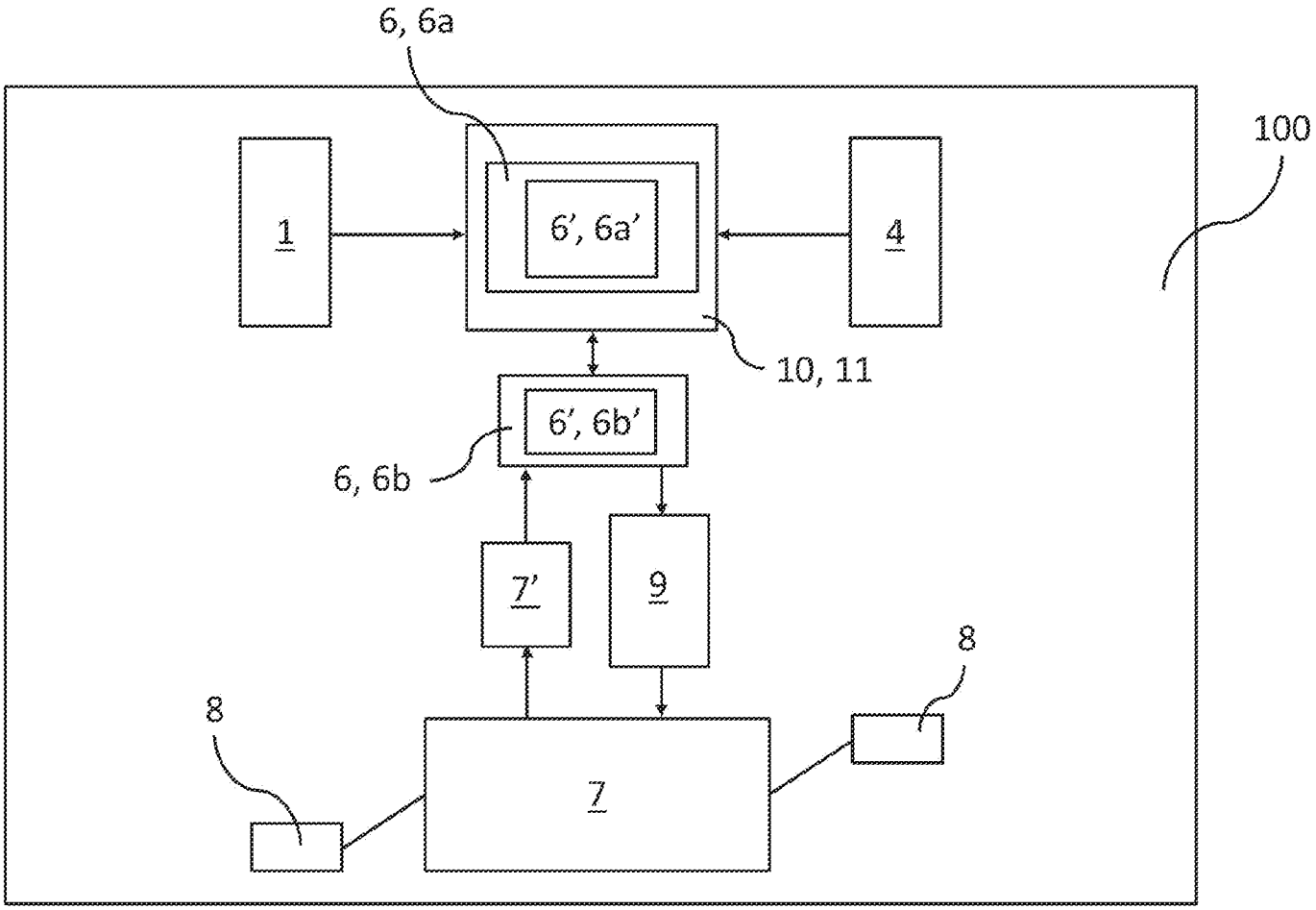
FIG. 4*b* shows, by means of a block chart, an exercise machine according to a further embodiment of the present invention.

With reference now to the aforesaid figures and also to the block chart in FIGS. 4*a* and 4*b*, in an embodiment, either in combination with or as an alternative to those described above, the exercise machine 100 comprises a first control device 1 which can be operated by a user to obtain a first variation of the percentage of the parameter representative of the athletic preparation of the user.

Indeed, it is worth noting that, as will be described below, the variation of a percentage of a parameter representative of the athletic preparation of the user is related to the absolute variation of the power delivered by the user during physical activity.

The first control device 1 is advantageously associated with a first portion 2 of the exercise machine 100 on which the user can place one or two hands during the normal training.

In the embodiment in the figures, in which the exercise machine 100 is an exercise bike, the first control device 1 is associated with a first handle 2 of a handlebar 3 of the exercise bike.

In this manner, when the user grips the first handle 2 with a hand, the first control device 1 can be advantageously reached by the fingers of the hand.

In the example of the figures, the first handle 2 is the right handle of the bike.

The exercise machine 100 further comprises a second control device 4 which can be operated by a user to obtain a second variation in the percentage of the parameter representative of the athletic preparation of the user.

The second control device 4 is advantageously associated with a second portion 5 of the exercise machine 100 on which the user can place one or two hands during the normal training.

In the embodiment in the figures, in which the exercise machine 100 is an exercise bike, the second control device 4 is associated with the second handle 5 of the handlebar 3 of the exercise bike.

In this manner, when the user grips the second handle 5 with a hand, the second control device 4 can be advantageously reached by the fingers of the hand.

In the example of the figures, the second handle 5 is the left handle of the exercise bike.

According to an embodiment, the first variation which can be obtained by operating the first control device 1 is an increase of the percentage value of the parameter representative of the athletic preparation of the user.

According to an embodiment, in combination with the preceding one, the second variation which can be achieved by operating the second control device 4 is a decrease of the percentage value of the parameter representative of the athletic preparation of the user.

According to a further embodiment, as an alternative to the preceding ones, the first variation which can be achieved by operating the first control device 1 is a decrease of the percentage value of the parameter representative of the athletic preparation of the user.

According to a further embodiment, in combination with the preceding one, the second variation which can be achieved by operating the second control device 4 is an increase of the percentage value of the parameter representative of the athletic preparation of the user.

It is worth noting that between the first variation which can be obtained by operating the first control device 1 and the second variation which can be obtained by operating the second control device 4 is a discrete variation of the value of the respectively associated parameter to be varied.

The discrete variation can be a variation of one unit from the previous value each time the respective control is operated (e.g. an increase or decrease of "1") or a variation of a set number of units from the previous value each time the respective control is operated (e.g. an increase or decrease of "5" or "10" or "20", etc.).

It is worth noting that the first variation which can be obtained by operating the first control device 1 or the second variation which can be obtained by operating the second control device 4 can be obtained by operating the first control device 1 or the second control device 4, respectively, for a set number of times necessary to reach the value of the respective parameter which the user wishes to set.

For example, if the first control device 1 and the second control device 4 are a button or lever adapted to operate a button, the first variation which can be obtained by operating the first control device 1 or the second variation which can be obtained by operating the second control device can be obtained by pressing the first control device 1 or the second control device 4 a set number of times until the value of the respective parameter that the user wishes to set is reached.

In an embodiment, either in combination with or as an alternative to the preceding one, the first variation which can be obtained by operating the first control device 1 or the second variation which can be obtained by operating the second control device can be obtained by operating the first control device 1 or the second control device 4 a number of times, respectively, or by operating and holding down the first control device 1 or the second control device 4, respectively, until the value that the user intends to set is reached by operating and holding down the first control device 1 actuated until the value of the respective parameter that the user intends to set is reached.

It is worth noting that if the first control device 1 and the second control device 4 are a button or lever adapted to operate a button, the operation of the button closes, for example, a switch in an electronic circuit which sends a corresponding electrical signal to a data processing module, described in detail below, which is responsible for controlling the exercise machine 100.

It is worth noting that the value of the percentage of the parameter representative of the athletic preparation of the user is among the parameters displayed by a display module of the exercise machine 100, described below.

In greater detail, the parameters which can be displayed on the display module, in addition to the value of the percentage of the parameter representative of the athletic preparation of the user, can also be the rotation speed of a rotating element of the exercise machine 100 (described below), the power value delivered by the user during the physical activity, the value of the parameter representative of the athletic preparation of the user and possibly other parameter values which can be controlled in other training modes performable by the exercise machine 100.

Therefore, at a set time, the user is aware of the current value of the percentage of the parameter representative of the athletic preparation of the user in the power-controlled training mode.

Such a current value may be the value previously set before the operation of the respective control device and any subsequent value obtained after the operation of the respective control device, i.e. also the value set at the end of the operation of the respective control device.

The variation of a percentage of a parameter representative of the athletic preparation of the user (e.g. a percentage of the user's functional threshold power value FTP) advantageously allows the user to set/adjust the exercise machine 100 quickly, effectively, and in a user-friendly manner to a percentage of their parameter representative of the athletic preparation of the user (e.g. their FTP) indicated by the personal trainer or desired by the user.

Furthermore, the variation delta of the target value of the power delivered by the user during the physical activity, at each increase or decrease (in an embodiment upon a command received by the user) of the user's FTP percentage, is advantageously calculated automatically by the exercise machine 100 as a function of the FTP.

Indeed, it reiterates that, in an embodiment, in the power-controlled training mode, in which the target power value is determined on the basis of the percentage of a parameter representative of the athletic preparation of the user, a change (increase or decrease) of the percentage of the parameter representative of the athletic preparation of the user (e.g. the percentage of FTP), which is equal for all users, corresponds to a change (increase or decrease, respectively) of the target power value delivered by the user during the physical activity, which is different from user to user.

Furthermore, it reiterates that, in a further embodiment, in the power-controlled training mode, in which the target power value is determined on the basis of the percentage of a parameter representative of the athletic preparation of the user, the determination of the target power value delivered by the user during the physical activity takes place, relative to a previous target power value, by varying the target power value by an absolute discrete value which is different from user to user, while the percentage of the parameter representative of the athletic preparation of the user (e.g. the percentage of FTP) is the same for all users.

Furthermore, the variation of a percentage of a parameter representative of the athletic preparation of the user advantageously allows the user to react immediately to a personal trainer's command to instruct the user to continue training at a set percentage of their parameter representative of the athletic preparation of the user (e.g. their FTP).

Indeed, the possibility of being able to directly vary the percentage value of their representative parameter of the athletic preparation of the user avoids the user having to calculate the required percentage mentally, with the possibility of error, also considering that the user may be under strain and/or fatigued, therefore not very lucid.

It reiterates that, in an embodiment, the percentage of the parameter representative of the athletic preparation of the user is manually variable by the operation, by the user, of the first control device 1 and the second control device 4.

According to a further embodiment, either in combination with or as an alternative to the preceding ones, the percentage of the parameter representative of the athletic preparation of the user is manually variable by the operation, by the user, of a control interface of the exercise machine 100, e.g. a touchscreen, described in detail below.

Instead, in a further embodiment, the percentage of the representative parameter of the athletic preparation of the user is automatically variable by the exercise machine 100 on the basis of a set trend (e.g. over time) set in the user's training program.

According to an embodiment, in combination with any one of those described above, the exercise machine 100 can be configured to switch from one training mode (e.g. resistance-controlled) to another (e.g. power-controlled, in which the target power value is determined on the basis of a percentage of a parameter representative of the athletic preparation of a user) and viceversa.

In this regard, in an embodiment, the switching may occur by simultaneously operating the first control device 1 and the second control device 4 by the user simultaneously for a set interval of time.

The operation can be, for example, applying pressure.

In this embodiment, as already mentioned above, the first control device 1 and the second control device 4 are advantageously a button or a lever adapted to operate a button, such as those shown in FIGS. 1*a*-1*b*, 2*a*-2*b*, 3*a*-3*b*.

Figure 3B:
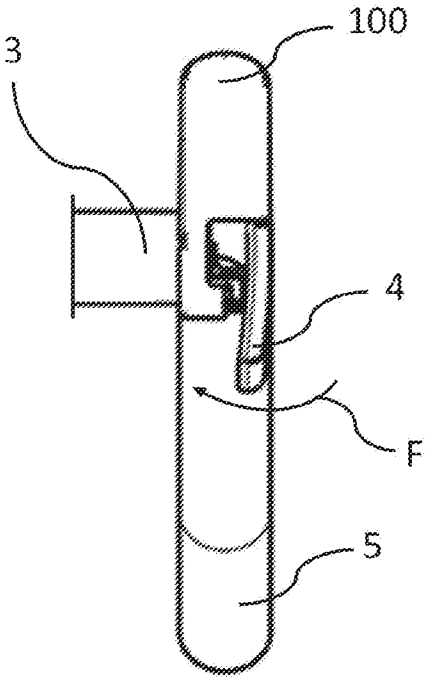
FIG. 3*b* shows an enlargement of a portion in FIG. 3*a;*
Figure 3A:
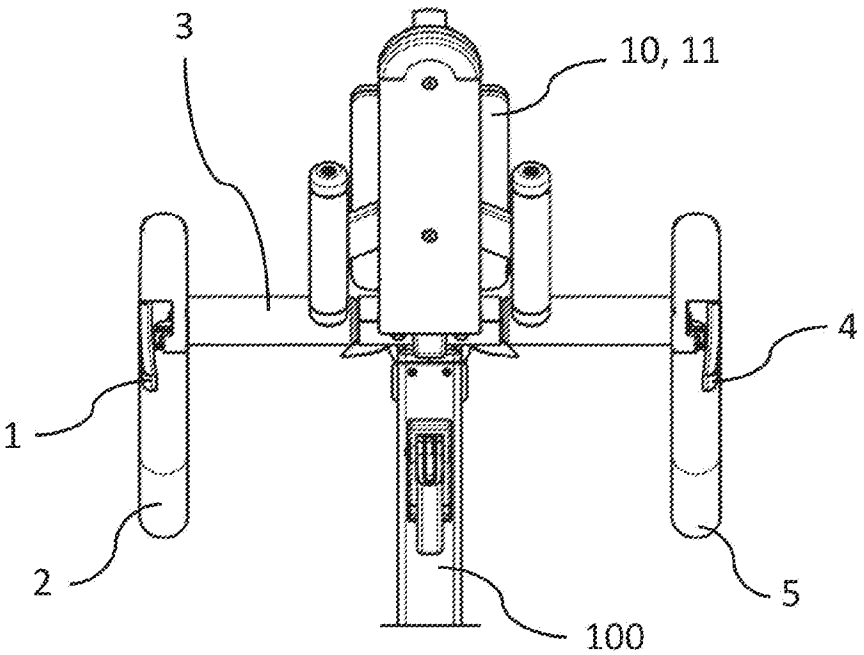
FIG. 3*a* shows a rear view of a portion of the exercise machine in FIG. 1*a;*

In particular, in FIG. 3*b*, an arrow F indicates the rotary movement which, for example, the second control device 4 is adapted to make for operating the variation of the first parameter of the first training mode of the exercise machine 100 or the second parameter of the second training mode of the exercise machine 100.

By operating the first control device 1 and the second control device 4 simultaneously for a set interval of time, the switching is only advantageously obtained if the user wishes to do so, i.e. if they apply a voluntary action (e.g. pressure) with both hands on each control device for a set interval of time, e.g. equal to 3 seconds.

It is worth noting that from the moment in which the switching occurs from resistance-controlled training mode to power-controlled training mode, for example, in which the target power value is determined on the basis of a percentage of a parameter representative of the athletic preparation of a user, the first control device 1 and the second control device 4 can be operated to obtain a first variation and a second variation of a percentage value of a parameter representative of the athletic preparation of a user, respectively.

In dual mode, from the moment in which the switching occurs, e.g. from the power-controlled training mode, in which the target power value is determined on the basis of a percentage of a parameter representative of the athletic preparation of a user, to the resistance-controlled training mode, the first control device 1 and the second control device 4 can be operated to obtain a first variation and a second variation of a resistance value of the exercise machine 100 in opposition to the physical activity of the user.

According to an embodiment, either in combination with or as an alternative to those described above, the switching of the exercise machine 100 from one training mode (e.g. resistance-controlled) to another one (e.g. power-controlled, in which the target power value is determined on the basis of a percentage of a parameter representative of the athletic preparation of a user) and viceversa may occur by operating, by the user, a specific control present on the control interface of the exercise machine 100, e.g. of touchscreen type, described below.

With reference now to FIGS. 4*a* and 4*b* as well, in an embodiment in combination with any one of those described above, the exercise machine 100 comprises a data processing module 6, e.g. a microcontroller or microprocessor.

Furthermore, the exercise machine 100 comprises a memory module 6' operatively connected to the data processing unit 6.

The memory module 6' may be internal (as diagrammatically shown in FIG. 4) or external to central processing module 6 (embodiment not shown in figures).

The data processing module 6, by loading and executing one or more program codes, stored in the memory module 6', is configured to control the exercise machine 100.

In this regard, in the embodiment shown in FIGS. 4*a* and 4*b*, the first control device 1 is operationally connected (in wired or wireless mode) to the data processing module 6.

Furthermore, in this embodiment, the second control device 4 is operationally connected (in wired or wireless mode) to the data processing module 6.

Therefore, the data processing module 6 is configured to perform a first variation of the percentage of a parameter representative of the athletic preparation of the user in the power-controlled training mode after the first control device 1 has been operated.

Furthermore, the data processing module 6 is configured to perform a second variation of the percentage of a parameter representative of the athletic preparation of the user in the power-controlled training mode after the second control device 4 has been operated.

If the exercise machine 100 takes the further resistance-controlled training mode, the data processing module 6 is configured to perform a first variation of a resistance value of the exercise machine in opposition to the physical activity of the user, following the operation of the first control device 1.

Furthermore, in this training mode, the data processing module 6 is configured to perform a second variation of a resistance value of the exercise machine in opposition to the physical activity of the user, following the operation of the second control device 4.

If the exercise machine 100 takes the further power-controlled training mode, in which the target power value is the absolute power value delivered by the user during the physical activity, the data processing module 6 is configured to perform a first variation of an absolute power value delivered by the user during the physical activity of the user, following the operation of the first control device 1.

Furthermore, in this training mode, the data processing module 6 is configured to perform a second variation of an absolute power value delivered by the user during the physical activity, following the operation of the second control device 4.

With reference now to the embodiment in the FIGS. 4*a* and 4*b*, if the exercise machine 100 is an exercise bike, the exercise machine 100 comprises a rotating element 7 which can be operated by a pair of pedals 8.

The rotating element 7 is, for example, a flywheel.

The rotating element 7 is operatively connected to the data processing module 6.

In this embodiment, the exercise machine 100 comprises a speed sensor 7' operationally associated with the rotating element 7.

The speed sensor 7' is also operatively connected to the data processing module 6.

The speed sensor 7' is configured to detect the rotation speed of the rotating element 7 (e.g. expressed in rpm) and provide the rotation speed of the rotating element 7 detected to the data processing module 6.

In this embodiment, the exercise machine 100 further comprises a brake device 9, e.g. a magnetic brake caliper, operationally associated with the rotating element 7.

The brake device 9 is operationally connected to the data processing module 6 (e.g. in wired or wireless mode).

The brake device 9 is configured to apply a braking action on rotating element 7 on the basis of a command which can be received from data processing module 6.

The braking action can be achieved by superimposing the brake device 9 (e.g. magnetic brake caliper) on the rotating element 7 (e.g. the flywheel).

In this regard, the braking action can be mechanical, magnetic, or electromagnetic on the basis of the type of brake device adopted.

If the brake device 9 is mechanical, the braking action can be applied onto the rotating element 7 by approaching a moving element with friction material of the ferodo type.

If the brake device 9 is of magnetic type, the braking action can be applied by progressively approaching or superimposing a movable element of magnetic type interacting with the rotating element 7.

If the brake device 9 is of electromagnetic type, the braking action can be applied by adjusting the electric current circulating in an element of electromagnetic type (electromagnet) which interacts electromagnetically with the rotating element 7.

In an embodiment, shown in FIG. 4*b*, the data processing module 6 may comprise a first logic unit 6*a* and a second logic unit 6*b*, operationally linked to each other.

The memory module 6' may comprise a first memory unit 6*a*', operationally connected to the first logic unit 6*a*, and a second memory unit 6*b*' operationally connected to the second logic unit 6*b*.

The first memory unit 6*a*' may be internal (as diagrammatically shown in FIG. 4*b*) or external to the first logic unit 6*a* (embodiment not shown in figures).

The second memory unit 6*b*' may be internal (as diagrammatically shown in FIG. 4*b*) or external to the second logic unit 6*b* (embodiment not shown in figures).

The first logic unit 6*a* is operationally connected to the first control device 1 (e.g. in wired or wireless mode), the second control device 4 (e.g. in wired or wireless mode), and the display module 10 (e.g. in wired mode).

The first logic unit 6*a* is located near the display module 10, preferably integrated within it. For this reason, the first logic unit 6*a* is also named "high-electronics".

The second logic unit 6*b* is operationally connected to the brake device 9 (e.g. in wired or wireless mode).

The second logic unit 6*b* is arranged near the brake device 9. For this reason, the second logic unit 6*b* is also named "low-electronics". The first logic unit 6*a*, by loading and executing one or more program codes, stored in the first memory unit 6*a*', is configured to perform user interface functions.

The second logic unit 6*a*, by loading and executing one or more program codes, stored in the second memory unit 6*b*', is configured to control the brake device 9.

With reference now to FIGS. 1*a*-1*b*, 2*a*-2*b*, 3*a*-3*b*, 4*a*, and 4*b*, if the exercise machine 100 is an exercise bike, a correlation table is stored in the memory module 6' indicating the correlation between a braking angle value (if the brake device 9 is mechanical or magnetic) or electric current value (if the brake device 9 is electromagnetic) and a respective braking torque value applied by the brake device 9 onto the rotating element 7.

In an embodiment, the correlation table is preferably determined on the bench while setting up the exercise machine 100.

In this manner, it is possible to avoid having to equip the exercise machine 100 with a braking torque sensor.

From the correlation table, a corresponding braking angle value can be determined from the braking torque value applied by the brake device 9 onto the rotating element 7, i.e. the superimposition angle between the brake device 9 and the rotating element 7, if the brake device 9 is of mechanical or magnetic type, or a corresponding electric current value to be regulated circulating in an electromagnetic type element (electromagnet), which electromagnetically interacts with the rotating element 7 if the brake device 9 is of the electromagnetic type.

In the power-controlled training mode, in which the target power value is determined on the basis of a percentage of a parameter representative of the athletic preparation of the user (e.g. FTP, described above), the data processing module 6 can perform the following operations.

First of all, following the selection of the power-controlled training mode, the data processing module 6 determines the power value delivered by the user during physical activity (e.g. pedaling) at the moment of selection.

Indeed, the data processing module 6, on the basis of the braking angle value (if the brake device 9 is of the mechanical or magnetic type) or electric current value (if the brake device 9 is of the electromagnetic type) determines the braking torque value applied by the brake device 9 on the rotating element 7 from the correlation table.

Furthermore, the data processing module 6, on the basis of the determined braking torque value and the rotation value of the rotating element 7 (provided by the speed sensor 7'), determines the corresponding value of power delivered by the user during the physical activity (power delivered by the user physical activity=rotation speed of the rotating element 7×rotating torque value of the rotating element 9 onto the rotating element 7).

Being known the value of power delivered by the user during the physical activity at the moment of selection and the user's FTP value, the data processing module 6 determines the percentage value of FTP is represented by the power value delivered by the user during the physical activity at the moment of selection.

By way of example, if the user's power output value is 110 watts and the user's FTP value is 220 watts at the moment of selection, then the determined FTP percentage is 50%.

The power delivered by the user during the physical activity determined at the moment of selection is the target value to be followed.

Following the operation of the first control device 1 or second control device 4 by the user, the user can vary (either increase or decrease) the FTP percentage value relative to the previously determined/set FTP percentage value.

It is worth noting that in an embodiment, instead, the percentage value of the parameter representative of the athletic preparation of the user can be varied automatically by the data processing module 6 on the basis of a set trend set in the user's training program.

As a result of such a variation (either manual or automatic), the data processing module 6 determines a new power target value delivered by the user during the physical activity on the basis of the set FTP percentage value.

By way of example, if the percentage value of FTP is equal to 50% and the first control device 1 (increase) or second control device 4 (decrease) causes a variation equal to 5%, the percentage value of FTP becomes 55% if the user operates the first control device 1 once.

Therefore, the data processing module 6 determines the value of 121 watts, i.e. 55% of the FTP value (220 watts), as a new target power value delivered by the user during the physical activity.

Once the target power value to be followed has been determined, the data processing module 6 allows the exercise bike to follow such a value by either increasing or decreasing the braking action which can be applied by the brake device 9 onto the rotating element 7.

In greater detail, the data processing module 6 determines the braking torque value applied by the brake device 9 onto the rotating element 7 (braking torque value applied by the brake device 9 on the rotating element 7=power value set by the user/rotational speed value of the rotating element 7) on the basis of the target power value to be followed and the rotation speed value of the rotating element 7 (supplied by the speed sensor 7').

It is worth noting that the data processing module 6 is configured to perform a cyclic control (at a set frequency) of the rotating speed value of the rotating element 7 and adjust the braking torque value so that the target power value delivered by the user during the physical activity is maintained, according to a mode described below.

In an alternative embodiment, the braking torque value applied by the brake device 9 on the rotating element 7 may be provided by a torque sensor (torque transducer or another technical equivalent), operationally connected to the data processing module 6, with which the exercise machine 100 is fitted.

It is worth noting that that the data processing module 6, according to the embodiments described above, is configured to perform a cyclic control (at a set frequency) of the rotating speed value of the rotating element 7 and adjust the braking torque value so that the target power value delivered by the user during physical activity is maintained in a manner described below.

From the correlation table, being known the braking torque value applied by brake device 9 on rotating element 7, if the brake device 9 is mechanical or magnetic, the data processing module 6 determines the corresponding braking angle value and modifies the position of the brake device 9 relative to the rotating element 7 until the braking angle value read in the correlation table is achieved or, if the brake device 9 is of the electromagnetic type, it determines the corresponding electric current value and adjusts the electric current value circulating in an electromagnetic type element (electromagnet) which electromagnetically interacts with the rotating element 7 until the electric current value read in the correlation table is reached.

In an embodiment, the target power value can be the one automatically provided by the training program set for the user.

Therefore, in this embodiment, the variation (either increase or decrease) of the power value to be followed takes place automatically without the user having to operate the first control device 1 or the second control device 4.

It reiterates that in the power-controlled training mode, in which the target power value is determined on the basis of a percentage of a parameter representative of the athletic preparation of the user (FTP), in the moment in which such a training mode is selected:

the first control device 1 and the second control device 4 can be operated to obtain a first variation and a second variation of a percentage value of FTP, respectively;

the exercise machine 100 is configured to perform the power-control by following the target power value delivered by the user while pedaling determined on the basis of a set percentage of FTP.

Turning back now again to the description of the exercise machine 100, according to an embodiment, in combination with any of those described above and illustrated in FIGS. 1*a*-1*b*, 2*a*-2*b*, 3*a*-3*b*, 4*a*, and 4*b*, the exercise machine 100 further comprises a display module 10.

The display module 10 is operationally connected to the data processing module 6 (e.g. in wired or wireless mode).

It is worth noting that in the embodiment in FIG. 4*b*, the display module 10 is operationally connected (e.g. in wired or wireless mode) to the first logic unit 6*a* of the data processing module 6.

The display module 10 can be used by the trainer user during the use of the exercise machine 100.

Indeed, the display module 10 is configured to show both content representative of the use of the exercise machine 100 (home menu screen for setting up the training; screen with parameters updated during the training; training summary screen, and so on) and multimedia entertainment content during the training (e.g.: Internet browsing; entertainment videos; audio/video music files, and so on) to the user.

Figure 5:
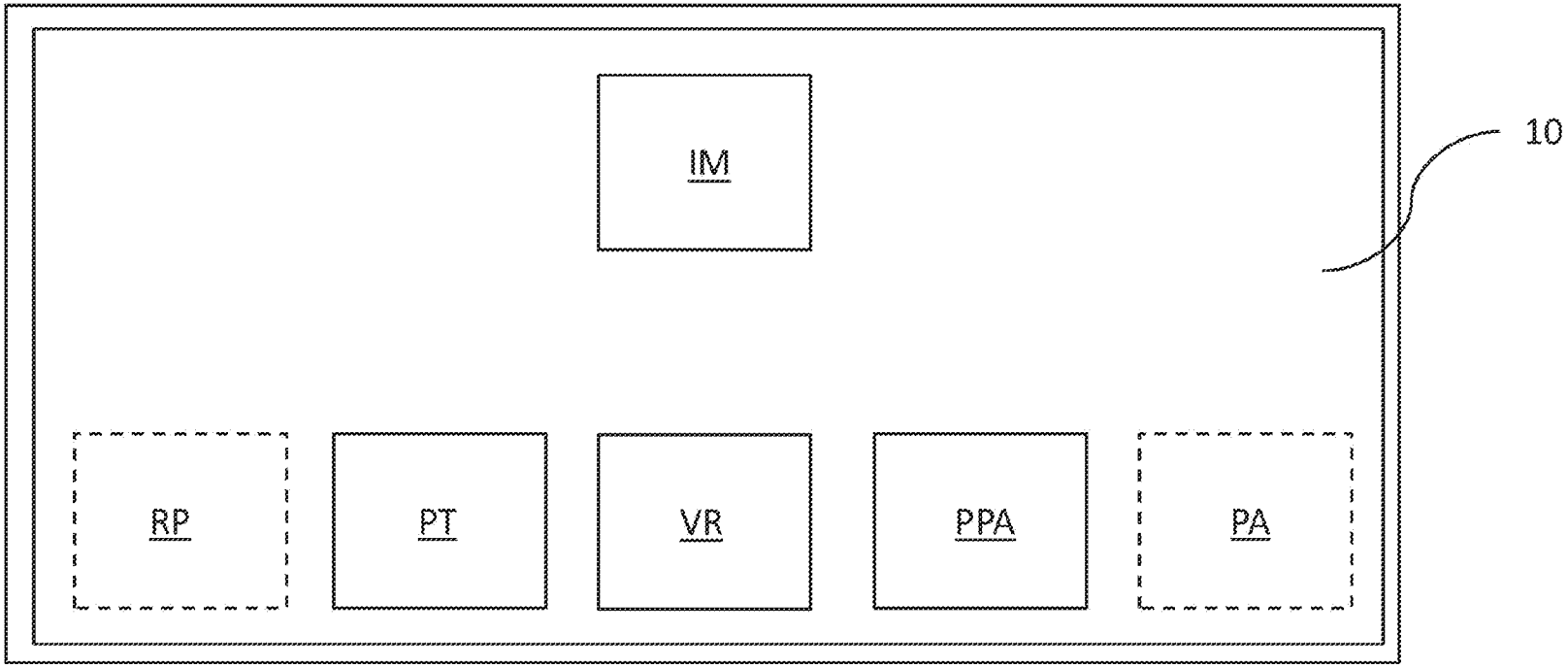
FIG. 5 diagrammatically shows a component of an exercise machine according to an embodiment of the present invention.

With reference also to FIG. 5, it is worth noting that, among the representative contents of the use of the exercise machine 100, in particular among the parameters which are updated during the training, the display module 10 is configured to show to the user the set value of a percentage PPA of a parameter PA representative of the athletic preparation of the user (either manually, by operating the first control device 1 and the second control device 4, or automatically, by the data processing module 6 on the basis of a set trend set in the user's training program).

In an embodiment, in combination with the preceding one, the display module 10 is further configured to show a rotation speed of a rotating element of the exercise machine 100 (described below), a value of the power PT delivered by the user during the physical activity and an indication IM representative of the training mode that the exercise machine 100 is executing to the user.

According to another embodiment, in combination with those described above, shown by dashed lines in FIG. 5, the display module 10 is further configured to show to the user the value of said parameter PA representative of said athletic preparation of the user and possibly other parameter values which can be controlled in other training modes which can be performed by the exercise machine 100, e.g. the resistance value RP which can be set in the resistance-controlled training mode.

According to an embodiment, either in combination with or as an alternative to any of those described above and illustrated in FIGS. 1*a*-1*b*, 2*a*-2*b*, 3*a*-3*b*, 4*a* and 4*b*, the exercise machine 100 further comprises a control interface 11, operationally connected to the data processing module 6, configured to allow a user to interact with the exercise machine 100.

It is worth noting that in the embodiment in FIG. 4*b*, the control interface 11 is operationally connected (e.g. in wired mode) to the first logic unit 6*a* of the data processing module 6.

In an embodiment, the control interface 11 may be of the touchscreen type.

In an embodiment, as an alternative to the preceding one, the control interface 11 may be a push-button keyboard.

In an embodiment, shown in any one of FIGS. 1*a*-1*b*, 2*a*-2*b*, 3*a*-3*b*, 4*a* and 4*b*, in combination with any of the preceding ones in which command interface 11 is a touchscreen, the display module 10 may coincide with the control interface 11.

According to a further embodiment, as an alternative to the preceding one and not shown in some of the figures, the display module 10 is separate from the control interface 11.

As mentioned above, according to other embodiments, either in combination with or as an alternative to those described above, the control interface 11, e.g. touchscreen, may be used by the user to vary the percentage of the parameter representative of the athletic preparation of the user and/or to switch the exercise machine 100 from one training mode to another and viceversa, by operating an appropriate provided by the control interface 11.

In greater detail, for example, the data processing module 6 is configured to perform a first variation in the percentage of a parameter representative of the athletic preparation of the user in the power-controlled training mode after the operation of an appropriate control (e.g. a button) present on the control interface 11.

Furthermore, the data processing module 6 is configured to perform a second variation in the percentage value of the parameter representative of the athletic preparation of the user in the power-controlled training mode after the operation of a further control (e.g. a further button) present on the control interface 11.

A power-controlled training method 60, which can be performed on an exercise machine 100, will now be described with reference now to FIG. 6.

The exercise machine 100 was described above.

The method 60 comprises a symbolic step of starting ST.

The method 60 comprises a step of varying 61 a percentage of a parameter representative of the athletic preparation of a user.

The method 60 further comprises a step of performing 62 the power-control by following a target power value delivered by the user during the physical activity. The target value is determined on the basis of a percentage of the parameter representative of the athletic preparation of the user.

In an embodiment, in the power-controlled training mode, in which the target power value is determined on the basis of the percentage of a parameter representative of the athletic preparation of the user, a change (increase or decrease) of the percentage of the parameter representative of the athletic preparation of the user (e.g. the percentage of FTP) which is equal for all users, corresponds to a change (increase or decrease, respectively) of the target power value delivered by the user during the physical activity, which is different from user to user.

In a further embodiment, either as an alternative to or in combination with the preceding one, in the power-controlled training mode, in which the target power value is determined on the basis of the percentage of a parameter representative of the athletic preparation of the user, the determination of the target power value delivered by the user during the physical activity takes place, with respect to a previous target power value, by varying the target power value by an absolute discrete value, which is different from user to user, while the percentage of the parameter representative of the athletic preparation of the user (e.g. the percentage of FTP) is the same for all users.

Figure 6:
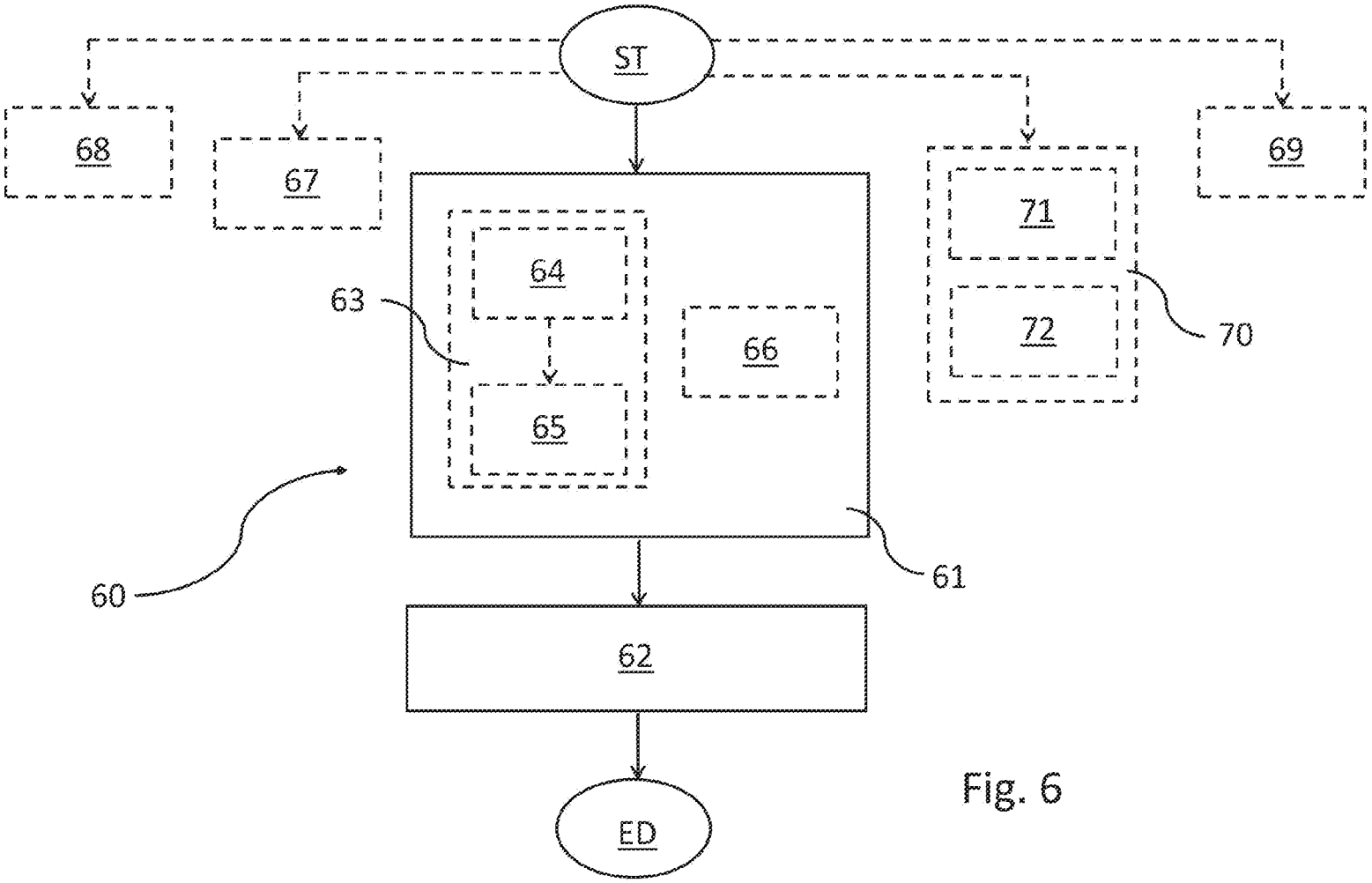
FIG. 6 shows, by means of a block chart, power-control training method, according to an embodiment of the invention.

In an embodiment, shown by dashed lines in FIG. 6, the step of varying 61 comprises a step of manually varying 63, by the user, the percentage of the parameter representative of the athletic preparation of the user.

In an embodiment, the step of manually varying 63 comprises a step of providing 64 a first control device 1, which can be operated by a user to obtain a first variation in a percentage of the parameter representative of the athletic preparation of a user.

The first control device 1, according to different embodiments, has been described above.

In this embodiment, the step of manually varying 63 further comprises a step of providing 65 a second control device 4 which can be operated by a user to obtain a second percentage variation of a parameter representative of the athletic preparation of a user.

The second control device 4, according to different embodiments, has been described above.

In an embodiment, either alternative to or in combination with the preceding ones, shown by dashed lines in FIG. 6, the step of varying 61 comprises a step of varying 66, automatically by the exercise machine 100, the percentage of the parameter representative of the athletic preparation of the user on the basis of a set trend (e.g. over time) set in a training program of the user.

In an embodiment, in combination with any of those described above, illustrated by dashed lines in FIG. 6, the method 60 further comprises a step of switching 67 the exercise machine 100 from the power-controlled training mode, in which the target value is determined on the basis of a percentage of a parameter representative of the athletic preparation of the user, to a further training mode or viceversa by operating the first control device 1 and the second control device 4 simultaneously for a set interval of time by the user. In an embodiment, the step of switching 67 is performed by the user by simultaneously applying pressure on the first control device 1 and the second control device 4 for a set interval of time.

According to an embodiment, shown by dashed lines in FIG. 6, the method 60 comprises a step of setting 68 a resistance-control training mode as a further training mode of the exercise machine 100.

The resistance-control training mode was described above.

In this embodiment, the first control device 1 and the second control device 4 can be operated to vary the resistance value of the exercise machine 100 in opposition to the physical activity of the user (pedaling, in the case of an exercise bike or stationary bicycle).

According to an embodiment, in combination with the preceding one, shown by dashed lines in FIG. 6, the method comprises a step of setting 69 a power-controlled training mode as a further training mode of the exercise machine 100, in which the target power value is an absolute value of the power delivered by the user during the physical activity, e.g. pedaling, in the case of an exercise bike or stationary bicycle.

The power-control training mode, in which the target power value is an absolute value of the power delivered by the user, during the physical activity, has also been described above.

In this embodiment, the first control device 1 and the second control device 4 can be operated to vary the absolute value of power delivered by the user during physical activity (pedaling, in the case of an exercise bike or stationary bicycle).

According to an embodiment, in combination with any one of those described above, shown by dashed lines in FIG. 6, the method 60 further comprises a step of displaying 70, by a display module 10 of the exercise machine 100, the set value of a percentage PPA of a parameter PA representative of the athletic preparation of the user (either manually, by operating the first control device 1 and the second control device 4, or automatically, by the data processing module 6 on the basis of a set trend set in the user's training program).

According to an embodiment, in combination with the preceding one, shown by dashed lines in FIG. 7, the step of displaying 70 comprises a step of displaying 71, by the display module 10 of the exercise machine 100, a rotation speed of a rotating element of the exercise machine 100 (described below), a value of the power PT delivered by the user during physical activity and an indication IM representative of the training mode that the exercise machine 100 is performing.

In an embodiment, either in combination with or as an alternative to the preceding ones, the step of displaying 70 further comprises a step of viewing 72, by the display module 10 of the exercise machine 100, the value of said parameter PA representative of said athletic preparation of the user and possibly other parameter values which can be controlled in other training modes, which can be performed by the exercise machine 100, e.g. the resistance value RP which can be set in the resistance-controlled training mode.

In an embodiment, in combination with any one of those described above, the percentage of the parameter representative of the athletic preparation of the user is the functional power threshold, FTP.

The method 60 comprises a symbolic step of ending ED.

An example of implementation of the power-controlled training method which can be performed on an exercise machine 100, e.g. an exercise bike, will now be described with reference to an embodiment in FIGS. 1*a*-1*b*, 2*a*-2*b*, 3*a*-3*b*, 4, and 5.

A user is training on an exercise bike 100 set to the power-controlled training mode, in which the target power value is determined on the basis of a percentage of a parameter representative of the athletic preparation of a user (e.g. the FTP).

Following a command from the personal trainer, the user, by operating the first control device 1, can increase the percentage value of a parameter representative of the athletic preparation of a user, i.e. increase the target value of the power delivered by the user during the physical activity to be followed by the exercise machine 100 in the power-controlled training mode.

In the same manner, in response to a command from the personal trainer, the user, by operating the second control device 4, can decrease the percentage value of a parameter representative of the athletic preparation of a user, i.e. decrease the target value of the power delivered by the user during the physical activity to be followed by the exercise machine 100 in the power-controlled training mode.

It is worth noting that the object of the present invention is fully achieved.

Indeed, the fact of being able to control a power-controlled training mode, by varying a percentage of a parameter representative of an athletic preparation of the user (e.g. FTP), allows the user to set a target power value which can be delivered by the user while pedaling (power-control) on the basis of a variation of a percentage of a parameter representative of an athletic preparation of the user so that the exercise machine 100 can actually be controlled according to the user's actual athletic preparation.

For example, in the case of a variation of a percentage of FTP, a user with a high FTP value (high-performance level) will have a higher delta of variation than a user with a low FTP value (low-performance level), therefore more parameterized to their (high) training level.

Furthermore, two users with different FTP values will vary by increasing or decreasing the same delta of variation of FTP percentage, which will correspond to two different absolute variations in power but will perceive the same increase/decrease of effort/intensity on the exercise machine 100.

For example:

- a first user with FTP equal to 100 watts, if the percentage variation is 5%, the variation delta will be 5 watts, i.e. 5% of 100 watts;
- a second user with FTP equal to 500 watts, if the percentage variation is also 5%, the variation delta will be 25 watts, i.e. 5% of 500 watts;

As a further example, it should be considered a training class of 3 users, with the following FTP values:

FTP1=75 watts (first user, not very trained);

FTP2=200 watts (second user, averagely trained);

FTP3=300 watts (third user, very well trained).

During a traditional training class, the trainer trains the users with a power-controlled training, e.g. by communicating the absolute training power values (expressed in watts), delivered by the users during the exercise, in the various intervals of time of the training.

The envisaged training type, in this case, may not be effective for all three users, because the trainer cannot make them work at the same power value because their level of preparation is not homogeneous.

Indeed, an increase of 50 watts that the trainer could require from the users would mean a power increase of about 66% of the FTP for the first user, who is not very trained, a power increase of about 25% of the FTP for the second user, who is averagely trained, and finally a power increase of about 16% of the FTP for the third user, who is very well trained.

It is apparent that under these conditions the first user will not be able to sustain such a 50-watt increase, while the third user will not perceive any training power at all.

According to the present invention, the exercise machine 100 is configured to perform a power-controlled training mode, in which the target power value is determined on the basis of a percentage of a parameter representative of an athletic preparation of a user, e.g. FTP.

The variation of a percentage of FTP required by the trainer, which is equal for all users, corresponds to an absolute power variation to reach the respective target value, which is different from user to user, who will be able to train at a power suited to their level of athletic preparation.

In the example of the three users above, during the training class, the trainer, referring to the FTP, will indicate at what percentage of FTP the users must work with so that the intensity of the effort is the same for all three.

The table in FIG. 7, already described above, is an example of a table that the trainers use as a reference to identify training zones or work for users.

A training power, for example, is typically the power near the threshold, in the third training zone Z3, between 76% and 90% of FTP, indicated as "time" and in the fourth training zone Z4 between 91% and 105% of FTP, indicated as "threshold".

The trainer can set the training by telling the users to set 70% of FTP on the exercise machine 100, which for the three users will be 52.5 watts for the first user who is not very trained, 140 watts for the second user who is averagely trained and 210 watts for the third user who is very well trained, respectively.

As can be noted, the absolute power values in comparison are very different but users train can effectively at the same intensity of effort.

At this point, the trainer informs the three users to increase the power by indicating the percentage increase compared to the set FTP value. For example, the trainer may indicate increasing the power value of FTP by 10% to 80%.

Then, the users will operate the respective control device to increase the percentage of the parameter representative of the athletic preparation of the user, and the exercise machine 100 will increase the absolute power value on the basis of the percentage of FTP, thereby determining the new target power value to be followed in the power-controlled training mode.

It reiterates that, in terms of percentage, the power variation delta is the same for all (10% of FTP), while it will be different in absolute terms, which for the three users will be 7.5 watts, 20 watts, and 30 watts, respectively.

It is worth noting that, advantageously, the control that the three users must provide to the machine will be the same because the data processing module 6 is configured to vary the target power value by determining it as a function of the percentage of FTP, specific to each user.

Furthermore, the fact of being able to control a power-controlled training mode by varying a percentage of a parameter representative of an athletic preparation of a user (e.g. FTP) allows the user to respond promptly to a personal trainer's request, without having to remember their FTP or mentally calculate the percentage of their FTP parameter, especially in conditions in which they under stress and/or fatigued.

Those skilled in the art may make changes and adaptations to the embodiments of the exercise machine and method thereof described above or can replace elements with others which are functionally equivalent to meet contingent needs without departing from the scope of the appended claims. Each of the features described above as belonging to a possible embodiment may be implemented irrespective of the other described embodiments.

The invention claimed is:

1. An exercise machine comprising:

a rotating element;

a brake device;

a processor operatively connected to the rotating element and the brake device, and configured to assume a power-controlled training mode; and a memory operatively connected to the processor and storing one or more training programs;

wherein the processor is configured to:

determine a value of functional threshold power (FTP) of a user at a moment of selection of a training mode, determine a power value delivered by the user during physical activity at the moment of selection of a power-controlled training mode;

set the power value delivered as a first target power value;

perform power control by following the first target power value, wherein performing power control by following the first target power value comprises controlling a rotating speed of the rotating element and adjusting a braking torque applied by the brake device to the rotating element, according to the first target power value;

determine a percentage value of the FTP, represented by the first target power value;

automatically vary the percentage value of the FTP, wherein the percentage value of the FTP is automatically variable based on a set trend set in one of the training programs of the one or more training programs stored in the memory;

determine a second target power value corresponding to the varied percentage value of the FTP; and perform power control by following the second target power value, wherein performing power control by following the second target power value comprises controlling the rotating speed of the rotating element and adjusting the braking torque applied by the brake device to the rotating element, according to the second target power value.

2. The exercise machine according to claim 1, wherein the processor is further configured to assume a further power-controlled training mode in which a power target value is determined based on an absolute value of power delivered by the user during physical activity.

3. The exercise machine according to claim 2, wherein the processor is configured to switch between the training modes.

4. The exercise machine according to claim 3, wherein the processor switches between the training modes when a specific control on a control interface of the exercise machine is operated.

5. The exercise machine according to claim 2, wherein the processor switches between the training modes when a specific control on a control interface of the exercise machine is operated.

6. The exercise machine according to claim 1, wherein in the power-controlled training mode, a variation of the percentage value of the FTP, the variation being equal for all users, corresponds to a variation of the power value delivered by the user during the physical activity, which is different from user to user.

7. The exercise machine according to claim 6, wherein in the power-controlled training mode, the second target power value is varied from the first target power value by an absolute discrete value which is different from user to user, while the variation of the percentage value of the FTP is the same for all users.

8. The exercise machine according to claim 1, further comprising:

a first control device operable by the user to obtain a first variation in the percentage value of the FTP; and a second control device operable by the user to obtain a second variation in the percentage value of FTP, the second variation being different than the first variation.

9. The exercise machine according to claim 8, wherein the first variation comprises an increase in the percentage value of the FTP, and wherein the second comprises a decrease in the percentage value of the FTP.

10. The exercise machine according to claim 1, wherein in the power-controlled training mode, the second target power value is varied from the first target power value by an absolute discrete value which is different from user to user, while the variation of the percentage value of the FTP is the same for all users.

11. The exercise machine according to claim 1, further comprising a display module configured to display the percentage value of the FTP.

12. The exercise machine according to claim 1, wherein the processor is further configured to assume a resistance-controlled training mode.

13. A power-controlled training method performed on an exercise machine comprising a rotating element, a brake device, and a processor operatively connected to the rotating element, the brake device and a memory storing one or more training programs, and configured to assume a power-controlled training mode, the method comprising:

determining, by the processor, a value of functional threshold power (FTP) of a user at a moment of selection of a training mode;

determining, by the processor, a power value delivered by the user during physical activity at the moment of selection of a power-controlled training mode;

setting, by the processor, the power value delivered as a first target power value;

performing, by the processor, power control by following the first target power value, wherein performing power control by following the first target power value comprises controlling a rotating speed of the rotating element and adjusting a braking torque applied by the brake device to the rotating element, according to the first target power value;

determining, by the processor, a percentage value of the FTP, represented by the first target power value;

automatically varying, by the processor, the percentage value of the FTP, wherein the percentage value of the FTP is automatically variable by the processor based on a set trend set in one of the training programs of the one or more training programs stored in the memory;

determining, by the processor, a second target power value corresponding to the varied percentage value of the FTP;

performing, by the processor, power control by following the second target power value, wherein performing power control by following the second target power value comprises controlling the rotating speed of the rotating element and adjusting the braking torque applied by the brake device to the rotating element, according to the second target power value.

14. The method according to claim 13, wherein in the power-controlled training mode, a variation of the FTP is set to be equal for all users, the variation of the FTP corresponds to a variation of the power value delivered by the user during the physical activity, which is different from user to user.

15. The method according to claim 14, wherein in the power-controlled training mode, the second target power value is varied from the first target power value by an absolute discrete value which is different from user to user, while the variation of the percentage value of the FTP is the same for all users.

16. The method according to claim 13, wherein in the power-controlled training mode, the second target power value is varied from the first target power value by an absolute discrete value which is different from user to user, while the variation of the percentage value of the FTP is the same for all users.

17. The method according to claim 13, further comprising displaying, by a display module of the exercise machine, the percentage value of the FTP.

* * * * *